US011536070B2

(12) United States Patent
Drzazga

(10) Patent No.: US 11,536,070 B2
(45) Date of Patent: Dec. 27, 2022

(54) DISH TREATING APPLIANCE WITH A DOOR OPENER

(71) Applicant: WHIRLPOOL CORPORATION, Benton Harbor, MI (US)

(72) Inventor: Mariusz Stanislaw Drzazga, Wroclaw (PL)

(73) Assignee: Whirlpool Corporation, Benton Harbor, MI (US)

( * ) Notice: Subject to any disclaimer, the term of this patent is extended or adjusted under 35 U.S.C. 154(b) by 285 days.

(21) Appl. No.: 16/892,650

(22) Filed: Jun. 4, 2020

(65) Prior Publication Data

US 2021/0381292 A1 Dec. 9, 2021

(51) Int. Cl.

| | |
|---|---|
| ***E05F 1/10*** | (2006.01) |
| ***A47L 15/42*** | (2006.01) |
| *A47L 15/22* | (2006.01) |
| *A47L 15/46* | (2006.01) |
| *A47L 15/48* | (2006.01) |

(52) U.S. Cl.

CPC ..... *E05F 1/10* (2013.01); *A47L 15/4259* (2013.01); *A47L 15/22* (2013.01); *A47L 15/4219* (2013.01); *A47L 15/4229* (2013.01); *A47L 15/4285* (2013.01); *A47L 15/4293* (2013.01); *A47L 15/46* (2013.01); *A47L 15/483* (2013.01); *A47L 15/486* (2013.01); *E05Y 2900/304* (2013.01)

(58) Field of Classification Search

CPC .. A47L 15/4259; A47L 15/22; A47L 15/4219; A47L 15/4229; A47L 15/4285; A47L 15/4293; A47L 15/46; A47L 15/483; A47L 15/486; E05Y 2900/304; E05Y 2201/426; E05Y 2201/422; E05F 11/54

USPC ..... 16/80; 49/344; 134/57 DL, 58 DL; 312/319.1–319.4, 319.8, 319.7, 228, 327, 312/328

See application file for complete search history.

(56) References Cited

U.S. PATENT DOCUMENTS

| | | | | |
|---|---|---|---|---|
| 9,885,141 | B2 * | 2/2018 | Becchio | E05B 47/0009 |
| 2011/0016907 | A1 * | 1/2011 | Kang | F25D 23/028 62/449 |

(Continued)

FOREIGN PATENT DOCUMENTS

| | | | |
|---|---|---|---|
| CN | 110946538 | A | 4/2020 |
| EP | 2568864 | B1 | 1/2015 |

(Continued)

OTHER PUBLICATIONS

European Patent Office, Extended Search Report re Corresponding Application No. 21177773.5-1016, dated Jul. 23, 2021, 5 pages, Munich, Germany.

*Primary Examiner* — Janet M Wilkens

(74) *Attorney, Agent, or Firm* — McGarry Bair PC

(57) ABSTRACT

A dish treating appliance includes a cabinet defining an interior with an access opening. A door is hingedly mounted to the cabinet for pivoting movement about a pivot axis between closed and opened positions to selectively close and open the access opening. A door opener includes a housing mounted to the cabinet and defining a pin opening facing the door. An opening pin is located within the housing and aligned with the pin opening. A lever is rotatably mounted to the housing to define a rotation axis and is selectively operably coupled to the opening pin. An actuator having a reciprocating shaft is connected to the lever.

20 Claims, 10 Drawing Sheets

(56) References Cited

U.S. PATENT DOCUMENTS

| | | | | |
|---|---|---|---|---|
| 2014/0132135 | A1* | 5/2014 | Becchi | E05B 17/0037 49/394 |
| 2015/0108885 | A1* | 4/2015 | Kang | A47L 15/4259 49/303 |
| 2016/0029872 | A1 | 2/2016 | Kim | |
| 2019/0032269 | A1 | 1/2019 | Gijare et al. | |
| 2021/0348434 | A1* | 11/2021 | Walz | E05B 47/0603 |

FOREIGN PATENT DOCUMENTS

| | | | | |
|---|---|---|---|---|
| EP | 2862495 | A1 | | 4/2015 |
| EP | 2995237 | A1 | | 3/2016 |
| EP | 3434821 | A1 | | 1/2019 |
| GB | 2431431 | | * | 4/2007 |
| KR | 20200142970 | | * | 12/2020 |
| KR | 20220027675 | | * | 3/2022 |
| WO | 2011141542 | | * | 11/2011 |
| WO | 2015082124 | A8 | | 6/2015 |
| WO | 2016020082 | A1 | | 2/2016 |

* cited by examiner

DISH TREATING APPLIANCE WITH A DOOR OPENER

BACKGROUND

Contemporary automatic dish treating appliances for use in a typical household include a cabinet with an access opening and a tub that can have an open front and at least partially defines a treating chamber into which items, such as kitchenware, glassware, and the like, can be placed to undergo a treating operation, such as washing. At least one rack or basket for supporting soiled dishes can be provided within the tub. A silverware or utensil basket for holding utensils, silverware, cutlery, and the like, may also be provided and is generally removably mounted to the door or within the dish rack.

The dishwasher can be provided with a door assembly, which can be hingedly mounted to the tub or to the cabinet for pivoting movement about a pivot axis between closed and opened positions to selectively close and open the open front and the access opening. The door can include a latch or a closure to selectively retain the door in the closed position. A door opener can be included to selectively bias the door toward the opened position. Such door openers can include, for example, a spring-loaded hinge system. However, such door openers that bias the door toward the opened position even when the door is retained in the closed position by the latch or closure can impair sealing of the door in the closed position by providing a force that is opposite to the latch or closure and to a door sealing system.

BRIEF DESCRIPTION

An aspect of the present disclosure relates to a dish treating appliance comprising a cabinet defining an interior with an access opening, a door hingedly mounted to the cabinet for pivoting movement about a pivot axis between closed and opened positions to selectively close and open the access opening, and a door opener comprising a housing mounted to the cabinet and defining a pin opening facing the door, an opening pin located within the housing and aligned with the pin opening, a lever rotatably mounted to the housing to define a rotation axis, and selectively operably coupled to the opening pin at first and second connections to correspondingly define first and second lever arms of different lengths, and an actuator having a reciprocating shaft connected to the lever at a third connection to define a third lever arm.

Another aspect of the present disclosure relates to a door opener for use with a door of a dish treating appliance that pivotably moves about a pivot axis between closed and opened positions, the door opener comprising a housing mounted to the dish treating appliance and defining a pin opening facing the door, an opening pin located within the housing and aligned with the pin opening, a lever rotatably mounted to the housing to define a rotation axis, and selectively operably coupled to the opening pin at first and second connections to correspondingly define first and second lever arms of different lengths, and an actuator having a reciprocating shaft connected to the lever at a third connection to define a third lever arm.

DETAILED DESCRIPTION

Figure 1:
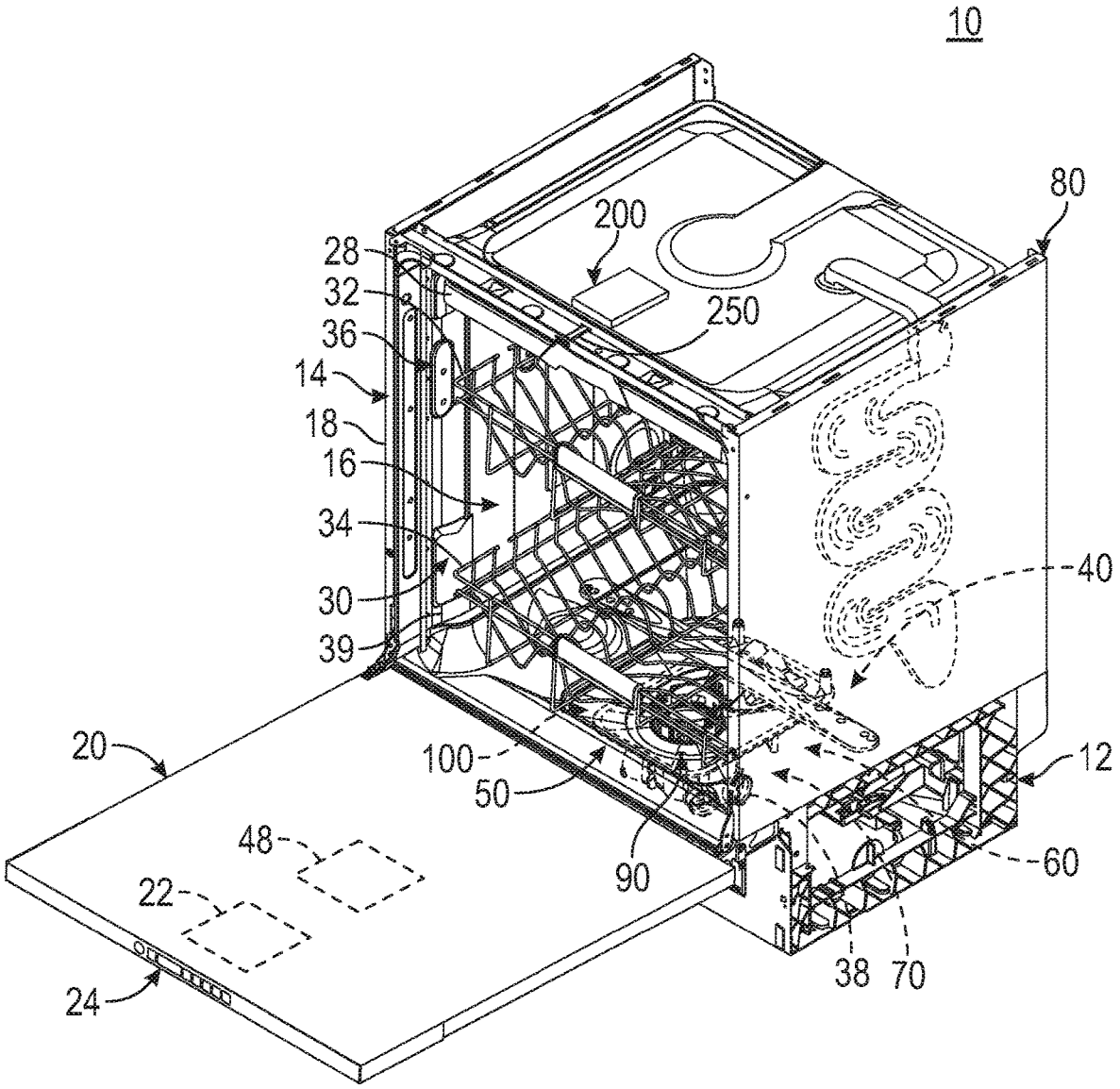
FIG. 1 is a right-side perspective view of an automatic dish treating appliance having multiple systems for implementing an automatic cycle of operation.

FIG. 1 illustrates an automatic dish treating appliance 10, illustrated herein as a dishwasher 10, capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, silverware, and other utensils. As illustrated, the dishwasher 10 is a built-in dishwasher implementation, which is designed for mounting under a countertop. However, this description is applicable to other dishwasher implementations such as a stand-alone, multi-tub-type, drawer-type, or a sink-type, for example, as well as dishwashers having varying widths, sizes, and capacities. The dishwasher 10 shares many features of a conventional automatic dishwasher, which may not be described in detail herein except as necessary for a complete understanding of aspects of the disclosure.

The dishwasher 10 has a variety of systems, some of which are controllable, to implement the automatic cycle of operation. A chassis or cabinet is provided to support the variety of systems needed to implement the automatic cycle of operation and defines an interior. As illustrated, for a built-in implementation, the chassis or cabinet includes a frame in the form of a base 12 on which is supported an open-faced tub 14, which at least partially defines a treating chamber 16, having an access opening, illustrated herein as an open face 18, for receiving the dishes.

A closure in the form of a door 20 or door assembly 20 can be hingedly or pivotally mounted to the base 12, or to any other suitable portion of the cabinet or chassis or of the tub 14, for pivoting movement about a pivot axis and relative to the tub 14 between opened and closed positions to selectively open and close the open face 18 of the tub 14. In the opened position, a user can access the treating chamber 16, as shown in FIG. 1, while, in the closed position (not shown), the door assembly 20 covers or closes the open face 18 of the treating chamber 16. Thus, the door assembly 20 provides selective accessibility to the treating chamber 16 for the loading and unloading of dishes or other items. A closure or latch assembly (not shown) can be provided to selectively retain the door assembly 20 in the closed position. A door opening assembly 200, illustrated herein as a door opener 200, is provided with the dishwasher 10 to selectively bias the door assembly 20 toward the opened position. The door opener 200 can be provided at any suitable location within the dishwasher 10, such as coupled to or mounted to the tub 14 or to another portion of the chassis or cabinet or the dishwasher 10. The door opener 200 comprises an opening pin 250 that is movable between a retracted position and an extended position to selectively contact and bear against the door assembly 20 to bias the door assembly 20 toward the opened position.

The chassis or cabinet, as in the case of the built-in dishwasher implementation, can be formed by other parts of the dishwasher 10, like the tub 14 and the door assembly 20, in addition to a dedicated frame structure, like the base 12, with them all collectively forming a uni-body frame by which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include a dish holding system 30, spray system 40, recirculation system 50, drain system 60, water supply system 70, drying system 80, heating system 90, and filter system 100. These systems are used to implement one or more treating cycles of operation for the dishes, for which there are many, one of which includes a traditional automatic wash cycle.

A basic traditional automatic cycle of operation for the dishwasher 10 has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The amounts of water, treating chemistry, and/or rinse aid used during each of the multiple wash or rinse steps can be varied. The wash phases and rinse phases can include the heating of the water, even to the point of one or more of the phases being hot enough for long enough to sanitize the dishes. A drying phase can follow the rinse phase(s). The drying phase can include a drip dry, a non-heated drying step (so-called "air only"), heated dry, condensing dry, air dry or any combination. These multiple phases or steps can also be performed by the dishwasher 10 in any desired combination.

A controller 22 can also be included in the dishwasher 10 and operably couples with and controls the various components of the dishwasher 10 to implement the cycles of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can provide an input and output function for the controller 22.

The user interface 24 can include operational controls such as one or more knobs, dials, lights, switches, displays, touch screens and the like for communicating with the user, such as enabling a user to input commands, such as a cycle of operation, to the controller 22 and to receive information, for example about the selected cycle of operation. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the dishwasher 10 and can allow the controller 22 to communicate with the user in a variety of ways. For example, the controller 22 can be configured to send a text message to the user, send an electronic mail to the user, or provide audio information to the user either through the dishwasher 10 or utilizing another device such as a mobile phone.

The controller 22 can include the machine controller and any additional controllers provided for controlling any of the components of the dishwasher 10. For example, the controller 22 can include the machine controller and a motor controller. Many known types of controllers can be used for the controller 22. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

The dish holding system 30 can include any suitable structure for receiving or holding dishes within the treating chamber 16. Exemplary dish holders are illustrated in the form of an upper dish rack 32 and lower dish rack 34, commonly referred to as "racks", which are located within the treating chamber 16. The upper dish rack 32 and the lower dish rack 34 each define an interior and are typically mounted for slidable movement in and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack 28 is slidably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack 28, it can be washed in the third level rack 28. The third level rack 28 generally has a much shorter height or lower profile than the upper and lower dish racks 32, 34. Typically, the height of the third level rack 28 is short enough that a typical glass cannot be stood vertically in the third level rack 28 and the third level rack 28 still be slid into the treating chamber 16.

Another dedicated dish holder can be a utensil or silverware basket (not shown), which is typically located in the treating chamber 16 and carried by one of the upper or lower dish racks 32, 34 or mounted to the door assembly 20. The silverware basket typically holds utensils and the like in an upright orientation as compared to the on-the-side or flat orientation of the third level rack 28. More than one silverware basket can be provided with the dishwasher 10.

A dispenser assembly 48 is provided to store and dispense treating chemistry, e.g. detergent, anti-spotting agent, etc., into the treating chamber 16. The dispenser assembly 48 can be mounted on an inner surface of the door assembly 20, as shown, or can be located at other positions within the chassis or treating chamber 16, such that the dispenser assembly 48 is positioned to be accessed by the user for refilling of the dispenser assembly 48, whether it is necessary to refill the dispenser assembly 48 before each cycle (i.e. for a single use dispenser) or only periodically (i.e. for a bulk dispenser). The dispenser assembly 48 can dispense one or more types of treating chemistries. The dispenser assembly 48 can be a single-use dispenser, which holds a single dose of treating chemistry, or a bulk dispenser, which holds a bulk supply of treating chemistry and which is adapted to dispense a dose of treating chemistry from the bulk supply during the cycle of operation, or a combination of both a single use and bulk dispenser. The dispenser assembly 48 can further be configured to hold multiple different treating chemistries. For example, the dispenser assembly 48 can have multiple compartments defining different chambers in which treating chemistries can be held.

Figure 2:
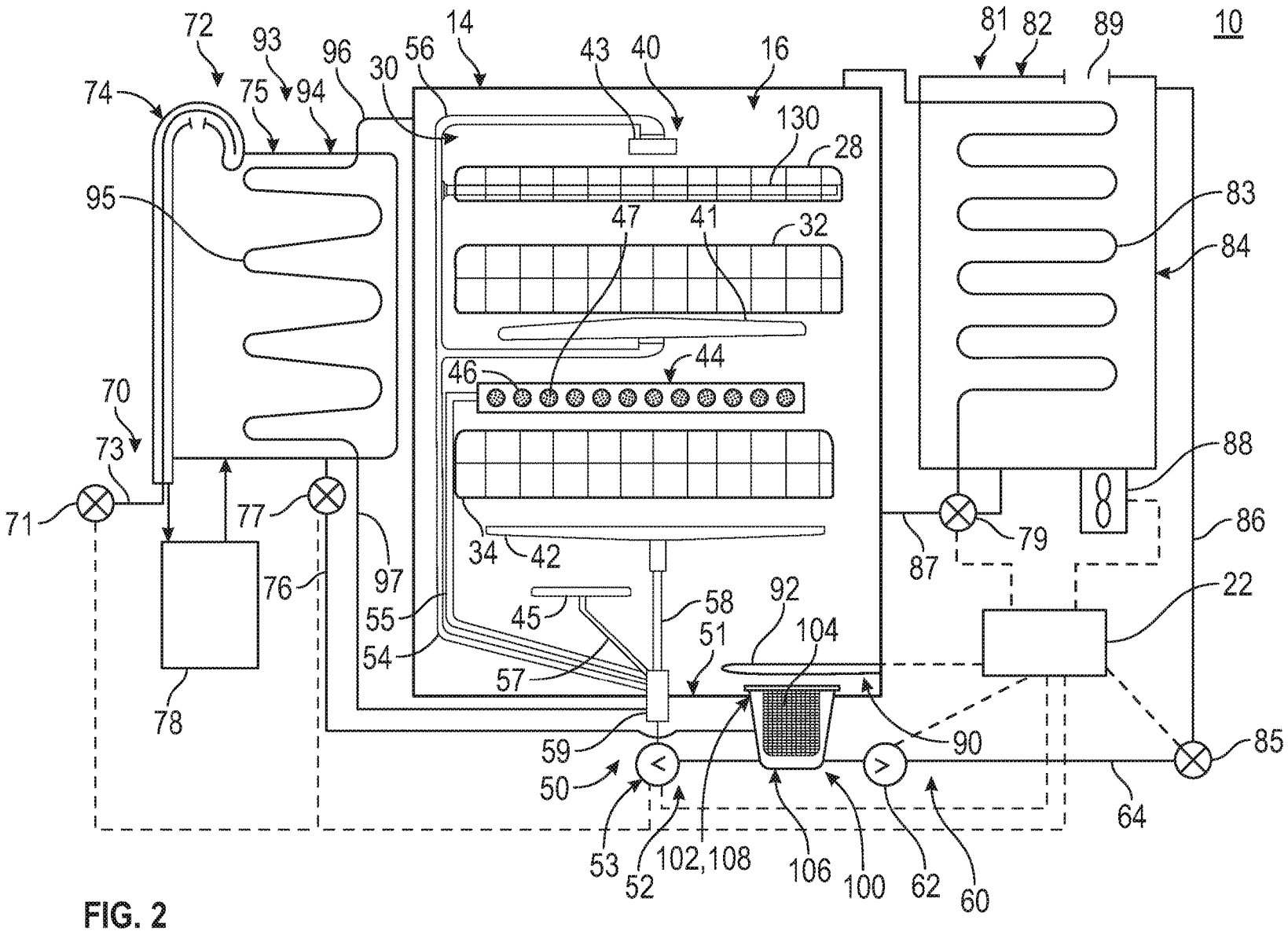
FIG. 2 is a schematic view of the dish treating appliance of FIG. 1 and illustrating at least some of the plumbing and electrical connections between at least some of systems.

Turning to FIG. 2, the spray system 40 is provided for spraying liquid in the treating chamber 16 and can have multiple spray assemblies or sprayers 41, 42, 43, 44, 45, 130, some of which can be dedicated to a particular one of the dish holders, to particular area of a dish holder, to a particular type of cleaning, or to a particular level of cleaning, etc. The sprayers 41, 42, 43, 44, 45, 130 can be fixed or movable, such as rotating, relative to the treating chamber 16 or dish holder. Exemplary sprayers 41, 42, 43, 44, 45, 130 are illustrated and include an upper spray arm 41, a lower spray arm 42, a third level sprayer 43, a deep-clean sprayer 44, and a spot sprayer 45. The upper spray arm 41 and lower spray arm 42 can be rotating spray arms, located below the upper dish rack 32 and lower dish rack 34, respectively, and rotate about a generally centrally located and vertical axis. The third level sprayer 43 is located above the third level rack 28. The third level sprayer 43 is illustrated as being fixed, but could move, such as in rotating. In addition to the third level sprayer 43 or in place of the third level sprayer 43, a sprayer 130 can be located at least in part below a portion of the third level rack 28, though it will be understood that such a sprayer 130 can be provided adjacent any of the racks 28, 32, 34. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or can move, such as by way of rotating. The spray emitted by the deep-clean sprayer 44 defines a deep clean zone, which, as illustrated, would extend along a rear side of the lower dish rack 34. Thus, dishes needing deep cleaning, such as dishes with baked-on food, can be positioned in the lower dish rack 34 to face the deep-clean sprayer 44. The deep-clean sprayer 44, while illustrated as only one unit on a rear wall of the tub 14, could comprise multiple units and/or extend along multiple portions, including different walls, of the tub 14, and can be provided above, below, or beside any of the dish holders 28, 32, 34 wherein deep cleaning is desired.

The spot sprayer 45, like the deep-clean sprayer 44, can emit an intensified and/or higher pressure spray, especially to a discrete location within one of the dish holders 28, 32, 34. While the spot sprayer 45 is shown below the lower dish rack 34, it could be adjacent any part of any dish holder 28, 32, 34 or along any wall of the tub 14 where special cleaning is desired. In the illustrated location below the lower dish rack 34, the spot sprayer 45 can be used independently of or in combination with the lower spray arm 42. The spot sprayer 45 can be fixed or can move, such as in rotating.

These sprayers 41, 42, 43, 44, 45, 130 are illustrative examples of suitable sprayers and are not meant to be limiting as to the type of suitable sprayers 41, 42, 43, 44, 45, 130. Additionally, it will be understood that not all of the exemplary sprayers 41, 42, 43, 44, 45, 130 need be included within the dishwasher 10, and that less than all of the sprayers 41, 42, 43, 44, 45, 130 described can be included in a suitable dishwasher 10.

The recirculation system 50 recirculates the liquid sprayed into the treating chamber 16 by the sprayers 41, 42, 43, 44, 45, 130 of the spray system 40 back to the sprayers 41, 42, 43, 44, 45, 130 to form a recirculation loop or circuit by which liquid can be repeatedly and/or continuously sprayed onto dishes in the dish holders 28, 32, 34. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps such as recirculation pump 53. The sump 51 can also be a separate module that is affixed to the bottom wall and include the pump assembly 52.

Multiple supply conduits 54, 55, 56, 57, 58 fluidly couple the sprayers 41, 42, 43, 44, 45, 130 to the recirculation pump 53. A recirculation valve 59 can selectively fluidly couple each of the conduits 54, 55, 56, 57, 58 to the recirculation pump 53. While each sprayer 41, 42, 43, 44, 45, 130 is illustrated as having a corresponding dedicated supply conduit 54, 55, 56, 57, 58, one or more subsets, comprising multiple sprayers from the total group of sprayers 41, 42, 43, 44, 45, 130, can be supplied by the same conduit, negating the need for a dedicated conduit 54, 55, 56, 57, 58 for each sprayer 41, 42, 43, 44, 45, 130. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits 54, 55, 56, 57, 58 can be directly coupled to the recirculation pump 53, while one or more of the other conduits 54, 55, 56, 57, 58 can be selectively coupled to the recirculation pump 53 with one or more valves. There are essentially an unlimited number of plumbing schemes to connect the recirculation system 50 to the spray system 40. The illustrated plumbing is not limiting.

The drain system 60 drains liquid from the treating chamber 16. The drain system 60 includes a drain pump 62 fluidly coupling the treating chamber 16 to a drain line 64. As illustrated, the drain pump 62 fluidly couples the sump 51 to the drain line 64.

While separate recirculation 53 and drain pumps 62 are illustrated, a single pump can be used to perform both the recirculating and the draining functions, such as by configuring the single pump to rotate in opposite directions, or by providing a suitable valve system. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to at least some extent.

A water supply system 70 is provided for supplying fresh water to the dishwasher 10 from a water supply source, such as a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit 73 is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 can be provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system 80 as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60, or water supply system 70, such that liquid can be supplied to the cooling tank 84. The liquid provided to the cooling tank 84 from any of the systems 40, 50, 60, 70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected based on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater 92, located in the treating chamber 16 at a location where it will be immersed by the water supplied to the treating chamber 16, such as within or near the sump 51. However, it will also be understood that the heater 92 need not be an immersion heater 92; it can also be an in-line heater located in any of the conduits. There can also be more than one heater 92, including both an immersion heater 92 and an in-line heater. The heater 92 can also heat air contained in the treating chamber 16. Alternatively, a separate heating element (not shown) can be provided for heating the air circulated through the treating chamber 16.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated, such as an ultrafiltration system.

Figure 3:
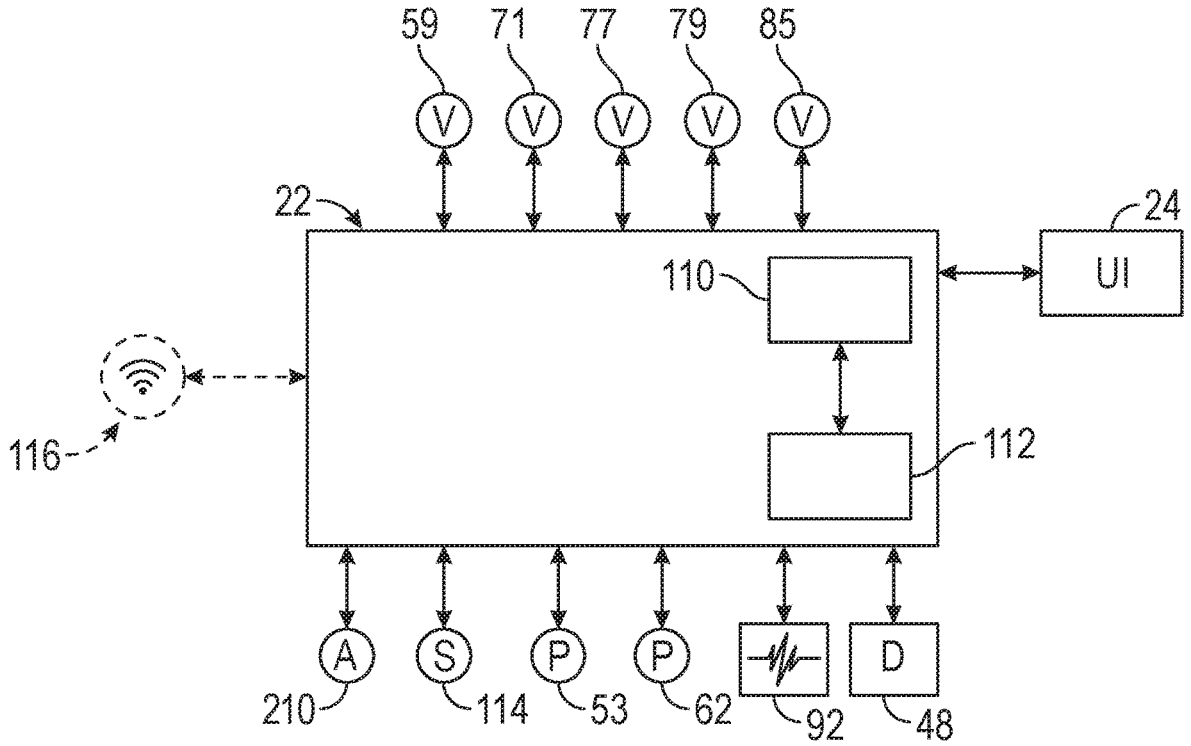
FIG. 3 is a schematic view of a controller of the dish treating appliance of FIGS. 1 and 2.

As illustrated schematically in FIG. 3, the controller 22 can be coupled with the heater 92 for heating the wash liquid during a cycle of operation, the drain pump 62 for draining liquid from the treating chamber 16, the recirculation pump 53 for recirculating the wash liquid during the cycle of operation, the user interface 24 for receiving user selected inputs and communicating information to the user, the dispenser assembly 48 for selectively dispensing treating chemistry to the treating chamber 16, and an actuator 210 for controlling the operation of and selectively actuating the door opener 200. The controller 22 can also communicate with the recirculation valve 59, the household water valve 71, the controllable valve 77, the return valve 79, and the valve 85 to selectively control the flow of liquid within the dishwasher 10. Optionally, the controller 22 can include or communicate with a wireless communication device 116.

The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store a set of executable instructions including one or more pre-programmed automatic cycles of operation that can be selected by a user and executed by the dishwasher 10. Examples, without limitation, of cycles of operation include: wash, heavy duty wash, delicate wash, quick wash, pre-wash, refresh, rinse only, timed wash, dry, heavy duty dry, delicate dry, quick dry, or automatic dry, which can be selected at the user interface 24. The memory 110 can also be used to store information, such as a database or table, and to store data received from one or more components of the dishwasher 10 that can be communicably coupled with the controller 22. The database or table can be used to store the various operating parameters for the one or more cycles of operation, including factory default values for the operating parameters and any adjustments to them by the control assembly or by user input.

The controller 22 can also receive input from one or more sensors 114 provided in one or more of the assemblies or systems of the dishwasher 10 to receive input from the sensors 114, which are known in the art and not shown for simplicity. Non-limiting examples of sensors 114 that can be communicably coupled with the controller 22 include, to name a few, an ambient air temperature sensor, a treating chamber temperature sensor, such as a thermistor, a water supply temperature sensor, a door open/close sensor, a moisture sensor, a chemical sensor, and a turbidity sensor to determine the soil load associated with a selected grouping of dishes, such as the dishes associated with a particular area of the treating chamber 16.

Figure 4:
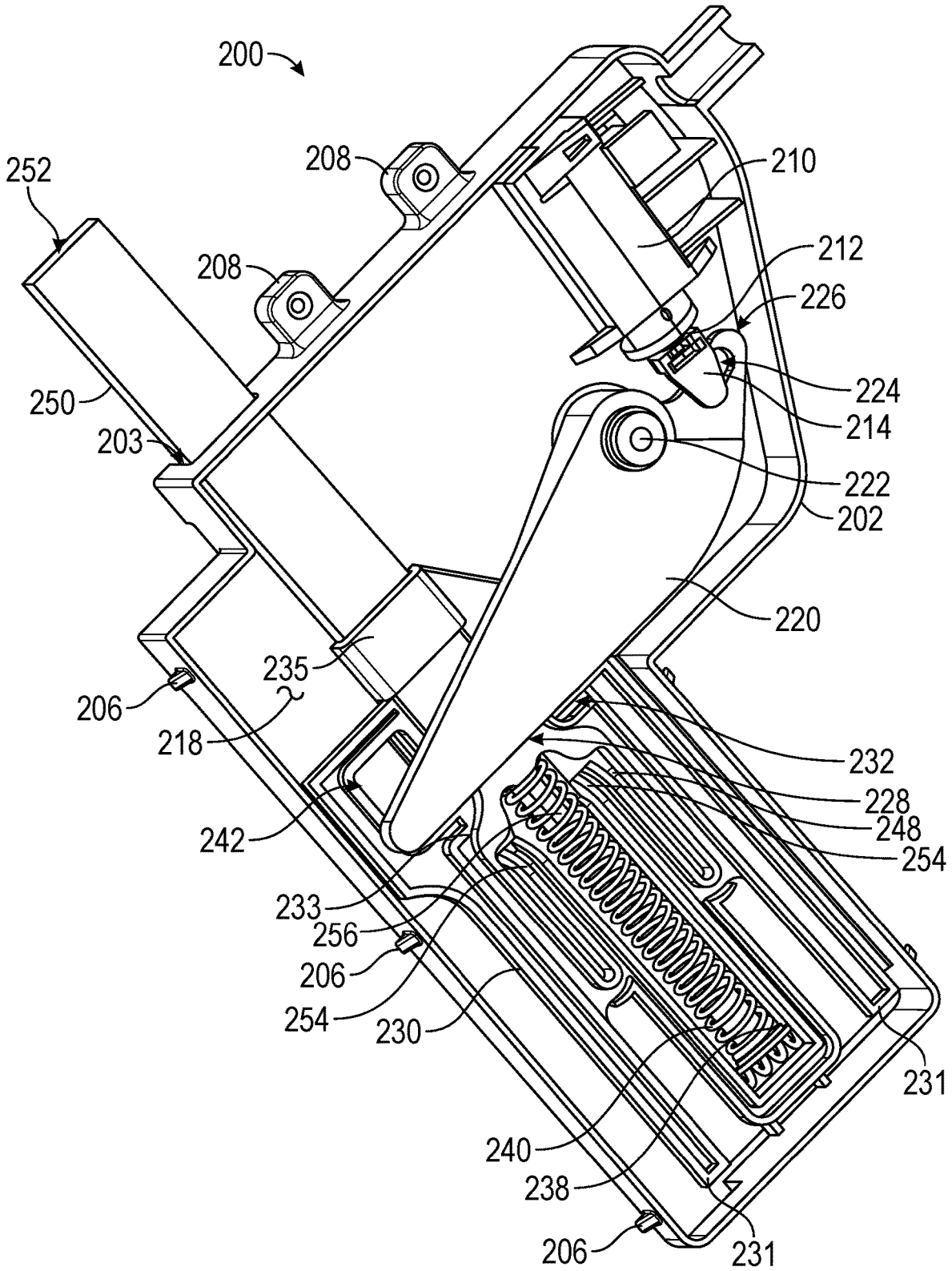
FIG. 4 is a top perspective view of a door opener for use with the dish treating appliance of FIG. 1, the door opener in a first position and shown with an upper housing removed for clarity.

Turning now to FIG. 4, the top perspective view illustrates the door opener 200 with a portion 204, illustrated herein as an upper housing 204 (FIG. 5), removed from a portion 202, illustrated herein as a lower housing 202, for clarity so that the components of the door opener 200 can be seen. The door opener 200 comprises the lower housing 202, the upper housing 204, the actuator 210, a lever 220, a slider 230, and the opening pin 250. The actuator 210, the lever 220, the slider 230, and the opening pin 250 are operably coupled to move the opening pin 250 between the retracted position and the extended position relative to the lower housing 202, the upper housing 204, and to the door assembly 20. The door opener 200 is presently shown in the retracted position.

The door opener 200 is at least partially defined by the lower housing 202 and the upper housing 204. In one example, the upper housing 204 can be thought of as a cover 204 for the lower housing 202. As illustrated herein, the lower housing 202 and the upper housing 204 can be thought of as collectively forming the housing 202, 204 for the door opener 200. In such an example, at least one fastener 206, illustrated herein as a plurality of snap elements 206, can be provided to couple the lower housing 202 and the upper housing 204. By way of non-limiting example, the snap elements 206 can allow for a snap fit of the upper housing 204 onto the lower housing 202, though it will be understood that any suitable type of fastener 206 or coupling mechanism can be used. Further, it will be also understood that the housing 202, 204 need not comprise the lower housing 202 and the upper housing 204, but could instead be provided as a single monolithic housing 202, 204.

In one example, the housing 202, 204 can be formed of an electrically insulative material to separate and protect electrical components within the housing 202, 204 from moisture, such as moisture that may occur as a result of a potentially wet dishwasher environment, or moisture that could come into contact with the housing 202, 204 from outside the dishwasher 10, such as from a liquid being spilled on a work surface above the dishwasher 10 that could then run towards the housing 202, 204. Alternatively, or additionally, the door opener 200 can be protected from exposure to moisture or liquid by the inclusion of at least one liquid deflection feature. By way of non-limiting example, a rib or embossment can be provided to deflect liquid or moisture away from the door opener 200, such as by providing the rib or embossment on an underside of the work surface, such as a countertop, or on an exterior of the tub 14 such that liquid that may be spilled on the work surface would be guided or directed into the tub 14, rather than toward the door opener 200.

The housing 202, 204 further comprises at least one mounting flange 208 for mounting or coupling the door opener 200, and specifically the lower housing 202, to the dishwasher 10. As illustrated in FIG. 1, the door opener 200 can be provided on top of the tub 14 such that the at least one mounting flange 208 can be used to mount the lower housing 202 to the tub 14, either directly or indirectly. However, it will be understood that such a location is non-limiting and that the door opener 200 can be positioned at any suitable location in the dishwasher 10, such as by being mounted or coupled to the tub 14, to the cabinet or chassis, or to another part of the dishwasher 10. Further, the at least one mounting flange 208 can be provided at any suitable position on the housing 202, 204, including on the upper housing 204 or at a different location on the lower housing 202. Any suitable type of fastener (not shown) can be used to couple the at least one mounting flange 208 to the tub 14, non-limiting examples of which include screws, bolts, or snap fit fasteners.

The housing 202, 204 further defines a pin opening 203 and a slideway 218. In one example, the pin opening 203 is defined by the lower housing 202 and faces the door assembly 20. The opening pin 250 is located within the housing 202, 204 and has at least a portion that is aligned with the pin opening 203 such that the opening pin 250 can be received within and extend through the pin opening 203 to an exterior of the housing 202, 204. The opening pin 250 defines an end 252 that selectively contacts the door assembly 20. The opening pin 250 is provided within the slideway 218 for sliding movement within the slideway 218 between the retracted position, as shown, and the extended position (FIG. 7) relative to the housing 202, 204 and to the door assembly 20. Specifically, the opening pin 250 is slidably received within the slideway 218 to selectively travel through a range of motion between the retracted position and the extended position. The slideway 218 can be oriented to be substantially horizontal, or the slideway 218 can be oriented at an angle relative to the horizontal. In one example, the slideway 218 is oriented at an acute angle relative to the horizontal such that the opening pin 250 is angled slightly downward moving toward the end 252 to form the acute angle relative to the horizontal.

The actuator 210 is operably coupled with and can be controlled by the controller 22. The actuator 210 is coupled to the lower housing 202, such as by mounting to the lower housing 202. The actuator 210 can be any suitable type of actuator, non-limiting examples of which include mechanical actuators, electrical actuators, or motors. In one example, the actuator 210 is a wax motor. The actuator 210 comprises a reciprocating shaft 212 that selectively extends from the actuator 210 between the retracted position and the extended position. A linker 214 is coupled to the end of the reciprocating shaft 212 that is opposite the actuator 210 and is configured to operably couple the reciprocating shaft 212 with the lever 220. The linker 214 includes a connection element 216, illustrated herein as a connecting peg 216 (FIG. 5), for coupling with the lever 220. Optionally, the connection element 216 can further comprise a connecting rib 216*b* (FIG. 5) that is provided in cooperation with the connecting peg 216 for coupling the linker 214 with the lever 220. It will be understood that it is also within the scope of the present disclosure for the linker 214 to be omitted or to be integral with the reciprocating shaft 212 such that the reciprocating shaft 212 directly couples with the lever 220.

The lever 220 is rotatably mounted to the housing 202, 204 to define a rotation axis 222 about which the lever 220 rotates relative to the housing 202, 204. The lever 220 can be thought of as having a first end 226 that interfaces and operably couples with the actuator 210 and a second end 228 that interfaces and operably couples with the opening pin 250, either directly or indirectly. The first end 226 defines a receiving opening 224 that receives the connecting peg 216 to operably couple the actuator 210, and specifically the reciprocating shaft 212 and the linker 214, with the lever 220.

The slider 230 is slidably received within the slideway 218 for sliding movement within the slideway 218 between the retracted and extended positions. As illustrated herein, the slider 230 can directly interface and operably couple with the lever 220, and specifically with the second end 228 of the lever 220, to selectively operably couple the lever 220 to the opening pin 250. The slider 230 defines a first connection opening 232 and a second connection opening 242 that interface with and operably couple with the second end 228 of the lever 220.

The slider 230 further interfaces with the opening pin 250 to operably couple the lever 220 to the opening pin 250 via the slider 230. The slider 230 comprises a slider body 231 that at least partially overlies the opening pin 250 and can be thought of as forming a first guide 231 for the opening pin 250. Specifically, the slider body 231 can include at least one shoulder 233 that forms at least a portion of the first guide 231. The at least one shoulder 233 is shaped and positioned so as to be complementary in contour to the opening pin 250 such that, as the slider 230 is moved from the extended position to the retracted position and away from the pin opening 203, the at least one shoulder 233 contacts the opening pin 250 to ensure that the opening pin 250 slides with the slider 230 away from the pin opening 203. In one example, the slider body 231 can also at least partially receive the opening pin 250. The slider 230 and the slider body 231 have at least a portion that is provided on the opposite side of the opening pin 250 as the lever 220, such that the opening pin 250 has at least a portion that is provided such that it lies between the lever 220 and the slider 230 with the slider body 231.

The slider body 231 further defines at least one coupling edge 248 that interfaces with the opening pin 250 and can also be thought of as forming at least a portion of the first guide 231 for the opening pin 250. The opening pin 250 comprises at least one deflectable arm 254 that is positioned to overlie and abut the coupling edge 248 of the slider 230 when the at least one deflectable arm 254 is in a non-deflected position as shown. In this way, as the slider 230 is moved from the retracted position to the extended position and toward the pin opening 203, the coupling edge 248 bears against the at least one deflectable arm 254 to slide the opening pin 250 with the slider 230 toward the pin opening 203. The at least one shoulder 233 of the slider body 231, the coupling edge 248, and the at least one deflectable arm 254 therefore are collectively configured to form at least a portion of the first guide 231 for the opening pin 250 and to operably couple the sliding movement of the slider 230 with the opening pin 250 throughout the full range of motion between the retracted position and the extended position. In this way, the opening pin 250 can further be thought of as being carried by the slider 230.

The pin opening 203, which can be provided as a slot 203 forming the pin opening 203, can be sized and shaped to be complementary to the shape and size of the portion of the opening pin 250 extending through the pin opening 203 such that the pin opening 203 can be thought of as forming a second guide 203 for the opening pin 250. Further still, the slider 230 includes a portion, illustrated herein as a collar 235, that overlies the opening pin 250 but is provided on the same side of the opening pin 250 as the lever 220, thus extending to the opposite side of the opening pin 250 from the remaining portions of the slider 230, and can be thought of as forming a third guide 235 for the opening pin 250. The collar 235 can be provided at any suitable position along the length of the opening pin 250. In one example, the collar 235, and thus also the third guide 235, are positioned along the length of the opening pin 250 so as to be positioned between the first guide 231 and the second guide 203 relative to the opening pin 250.

In one non-limiting example, the slider 230 and the opening pin 250 are movably coupled to one another, such that relative movement between the slider 230 and the opening pin 250 is selectively allowed. Specifically, the opening pin 250 can be slidably mounted to the slider 230 for selective sliding movement relative to the slider 230. In such an example, the slider 230 further comprises a first spring seat 238, with the opening pin 250 further comprising a second spring seat 256, the second spring seat 256 positioned to oppose the first spring seat 238. A spring 240 is provided to extend between the first and second spring seats 238, 256, and specifically to be mounted about and between the first and second spring seats 238, 256 to couple the opening pin 250 with the slider 230 to selectively allow relative sliding movement of the opening pin 250 relative to the slider 230 when the spring 240 is compressed. While the door opener 200 is illustrated herein as including the spring 240 extending between and coupling the opening pin 250 with the slider 230, it will be understood that any suitable damping or shock absorbing element could be provided and is not limited to a spring 240. Alternatively, or additionally, rather than providing the spring 240 to extend between and couple the opening pin 250 with the slider 230, the spring 240 can be integrated with either one of the opening pin 250 or the slider 230, rather than as a separate piece.

While the door opener 200 has been described herein as including the slider 230 and the opening pin 250 as separate elements that are capable of moving relative to one another, it will also be understood that such a description is not limiting. By way of non-limiting example, it would be within the scope of the present disclosure for the structures of the slider 230 and the opening pin 250 to be provided as a single monolithic opening pin 250 that includes the first connection opening 232 and the second connection opening 242 to interface with and operably couple with the second end 228 of the lever 220. In such an example, relative movement between the opening pin 250 and the first and second connection openings 232, 242 could not be permitted and the first and second spring seats 238, 256, as well as the spring 240, could be eliminated or could be integrated with either of the opening pin 250 or the slider 230.

Figure 5:
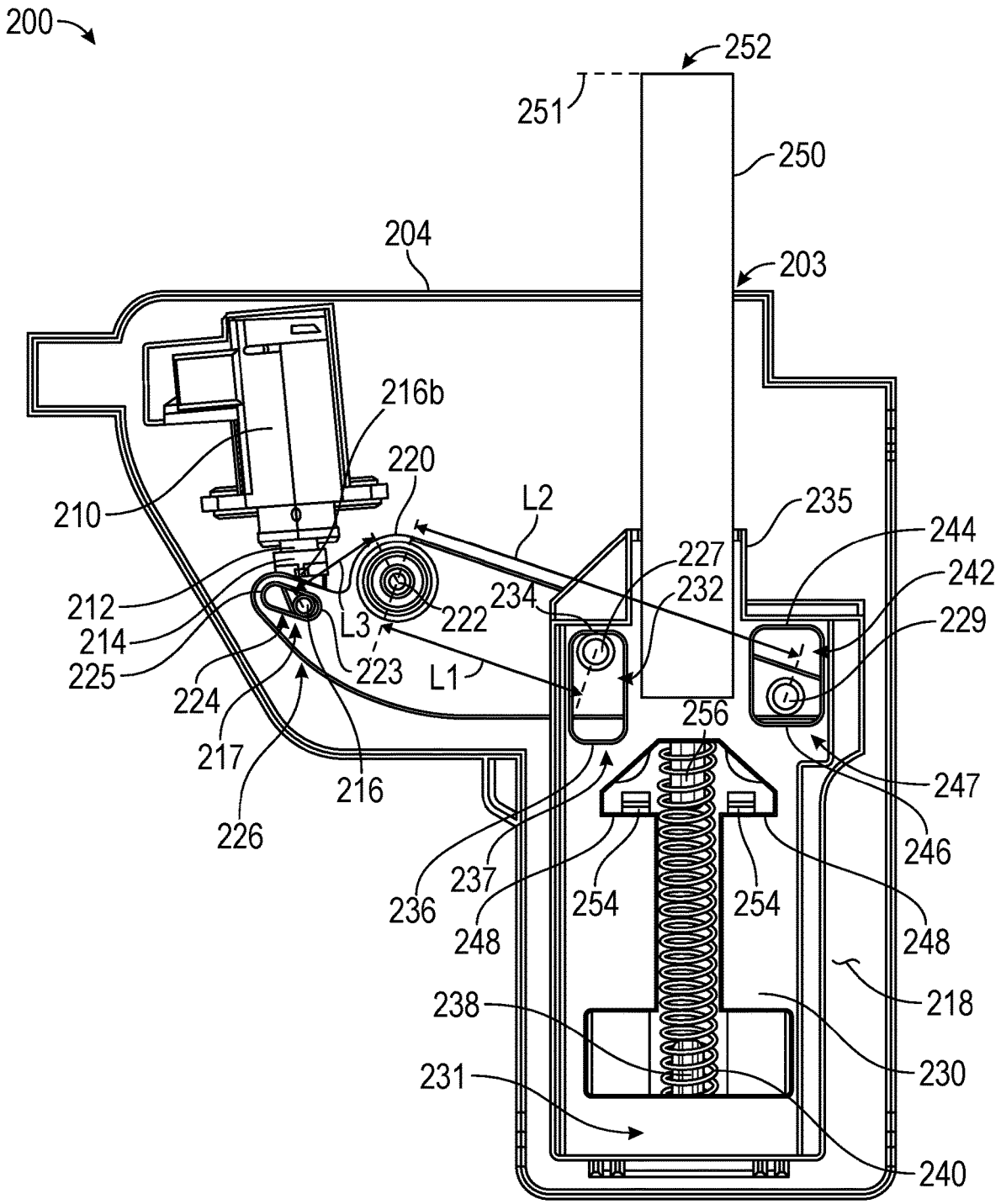
FIG. 5 is a bottom view of the door opener of FIG. 4 in the first position and shown with a lower housing removed for clarity.

Turning now to FIG. 5, the bottom view illustrates the door opener 200 still in the first, retracted position as in FIG. 4, but with the upper housing 204 shown and the lower housing 202 removed for clarity, such that the connections of the lever 220 with the actuator 210 and the slider 230 are more easily seen. The second end 228 of the lever 220 further comprises a first connection element 227 and a second connection element 229. The first and second connection elements 227, 229 can be spaced from one another such that the first and second connection elements 227, 229 are provided at different distances from the rotation axis 222. For example, the first and second connection elements 227, 229 can be positioned on opposite sides of the opening pin 250 from one another. By way of non-limiting example, the first and second connection elements 227, 229 can be provided as first and second connection pegs or pins 227, 229 that extend from the lever 220 and towards the opening pin 250 and the slider 230.

The first connection opening 232 defines a first surface 234, illustrated herein as a front surface 234, and a second surface 236, illustrated herein as a rear surface 236. The first connection element 227 is received within the first connection opening 232 such that the first connection element 227 is retained within the first connection opening 232 for movement between the front surface 234 and the rear surface 236 as the opening pin 250 moves between the retracted and extended positions. The first connection opening 232 and the first connection element 227 can be thought of as collectively forming a first connection 237 of the lever 220 to define a first lever arm having a first length L1, wherein the first length L1 of the first lever arm formed by the first connection 237 is the distance between the rotation axis 222 and the first connection element 227. The first connection 237 formed by the first connection opening 232 and the first connection element 227 selectively connects the lever 220, and specifically the second end 228 of the lever 220, to the slider 230, in turn selectively operably coupling the lever 220, and specifically the second end 228 of the lever 220, to the opening pin 250.

In the same way, the second connection opening 242 defines a first surface 244, illustrated herein as a front surface 244, and a second surface 246, illustrated herein as a rear surface 246. The second connection element 229 is received within the second connection opening 242 such that the second connection element 229 is retained within the second connection opening 242 for movement between the front surface 244 and the rear surface 246 as the opening pin 250 moves between the retracted and extended positions. The second connection opening 242 and the second connection element 229 can be thought of as collectively forming a second connection 247 of the lever 220 to define a second lever arm having a second length L2, wherein the second length L2 of the second lever arm formed by the second connection 247 is the distance between the rotation axis 222 and the second connection element 229. The second connection 247 formed by the second connection opening 242 and the second connection element 229 selectively connects the lever 220, and specifically the second end 228 of the lever 220, to the slider 230, in turn selectively operably coupling the lever 220, and specifically the second end 228 of the lever 220, to the opening pin 250. In one example, the first length L1 of the first lever arm differs from the second length L2 of the second lever arm. Further by way of non-limiting example, the second length L2 of the second lever arm can be greater than the first length L1 of the first lever arm.

Similarly, the connecting peg 216, which can be thought of as a third connection element 216, extends from the linker 214 and towards the lever 220. The receiving opening 224, which can be thought of as a third connection opening 224, defines a first end 223 and a second end 225. In one example, the first end 223 can be the end 223 of the receiving opening 224 that is nearer to the opening pin 250, while the second end 225 is further from the opening pin 250 than the first end 223 is. The connecting peg 216 is received within the receiving opening 224 such that the connecting peg 216 is retained within the receiving opening 224 for movement between the first end 223 and the second end 225 as the opening pin 250 moves between the retracted and extended positions. The connecting peg 216 and the receiving opening 224 can be thought of as collectively forming a third connection 217 of the lever 220 to define a third lever arm having a third length L3, wherein the third length L3 of the third lever arm formed by the third connection 217 is the distance between the rotation axis 222 and the connecting peg 216. The third connection 217 formed by the receiving opening 224 and the connecting peg 216 selectively connects and operably couples the lever 220, and specifically the first end 226 of the lever 220, to the actuator 210, and specifically to the reciprocating shaft 212.

Figure 7:
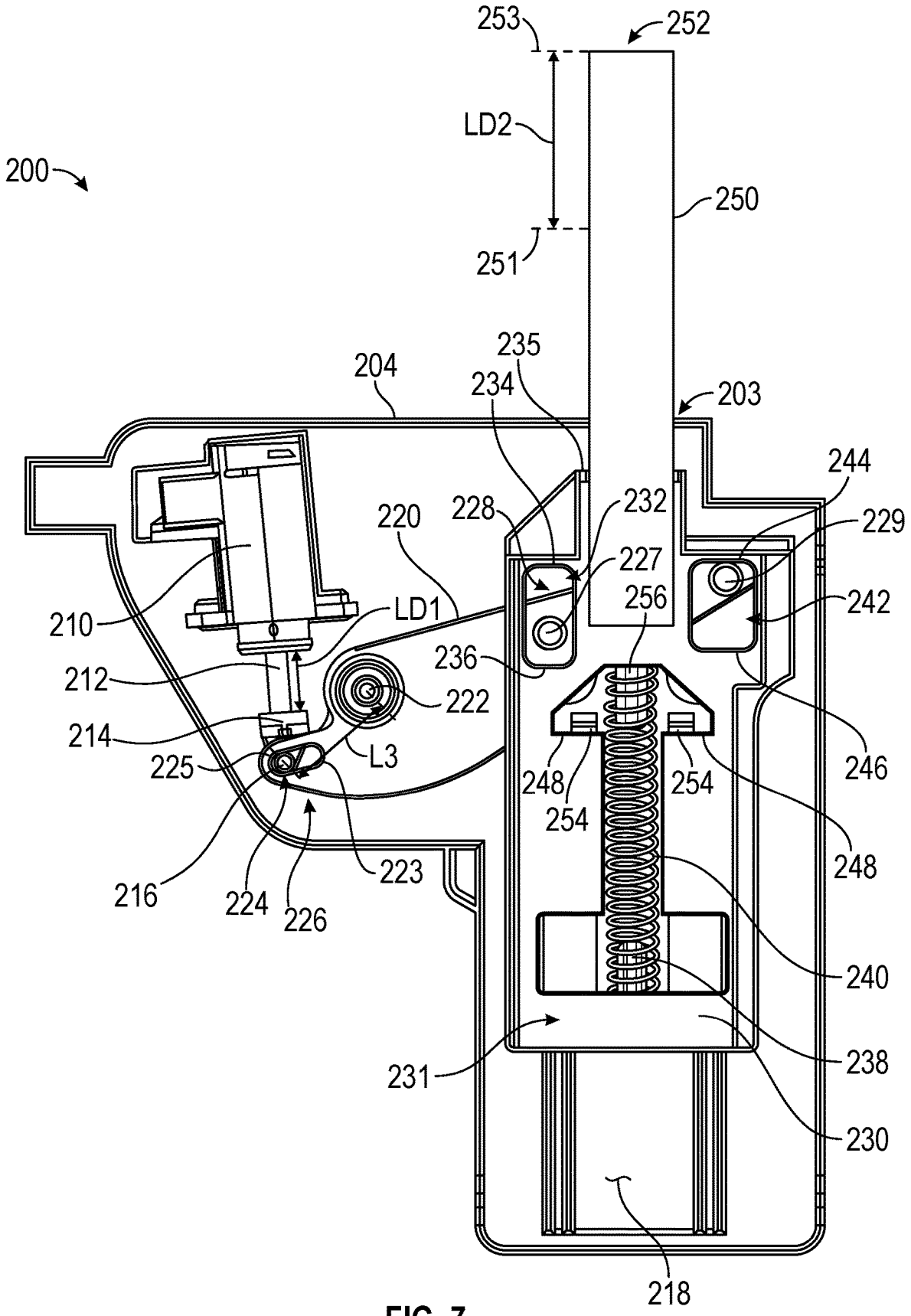
FIG. 7 is a bottom view of the door opener of FIG. 4 in a third position and shown with a lower housing removed for clarity.

The lengths L1, L2, L3 of the lever arms formed by the first, second, and third connections 217, 237, 247, as well as the ratios of the lengths L1, L2, L3, determine a total linear distance LD2 (FIG. 7) that can be traveled by the opening pin 250 as the opening pin 250 moves from the retracted position, as indicated by a dashed line 251, to the extended position, as indicated by a dashed line 253 (FIG. 7). Further, the linear distance LD2 traveled by the opening pin 250 can be compared to a total linear distance LD1 (FIG. 7) that can be traveled by the reciprocating shaft 212 of the actuator 210 as the reciprocating shaft 212 moves from the retracted position to the extended position to determine a ratio of the linear distance LD2 traveled by the opening pin 250 to the linear distance LD1 traveled by the reciprocating shaft 212. A higher ratio of the linear distance LD2 to the linear distance LD1 indicates more efficient operation of the door opener 200, as the linear distance LD2 traveled by the opening pin 250 is increased relative to the linear distance LD1 traveled by the reciprocating shaft 212, resulting in more linear movement achieved by the opening pin 250 per unit of power used by the actuator 210 to move the reciprocating shaft 212 the linear distance LD1.

In one non-limiting example, the third length L3 of the third lever arm differs from both the second length L2 of the second lever arm and from the first length L1 of the first lever arm. Therefore, the ratio of the first length L1 of the first lever arm to the third length L3 of the third lever arm is also different than the ratio of the second length L2 of the second lever arm to the third length L3 of the third lever arm. Further by way of non-limiting example, the third length L3 of the third lever arm can be less than the first length L1 of the first lever arm and less than the second length L2 of the second lever arm, and, additionally, the first length L1 of the first lever arm can be less than the second length L2 of the second lever arm. Therefore, the ratio of the first length L1 of the first lever arm to the third length L3 of the third lever arm is less than the ratio of the second length L2 of the second lever arm to the third length L3 of the third lever arm.

At least one of the first connection 237 between the first connection element 227 and the first connection opening 232, the second connection 247 between the second connection element 229 and the second connection opening 242, or the third connection 217 between the connecting peg 216 and the receiving opening 224 comprises a motion take-up connection 217, 237, 247. In the non-limiting illustrated example, each of the first connection 237 between the first connection element 227 and the first connection opening 232, the second connection 247 between the second connection element 229 and the second connection opening 242, and the third connection 217 between the connecting peg 216 and the receiving opening 224 comprises a motion take-up connection 217, 237, 247, though it will be understood that less than all of the connections 217, 237, 247, such as one or two of the connections 217, 237, 247, can be provided as motion take-up connections 217, 237, 247.

In the illustrated motion take-up connections 217, 237, 247, each of the first connection opening 232, the second connection opening 242, and the receiving opening 224 are sized larger than the corresponding first connection element 227, second connection element 229, and the connecting peg 216. Thus, each of the first connection element 227, the second connection element 229, and the connecting peg 216 can move or travel within the corresponding first connection opening 232, second connection opening 242, and receiving opening 224 as the opening pin 250 moves between the retracted and extended positions. For example, the first and second connection elements 227, 229 can move or travel through a range of motion between the front surfaces 234, 244 and the rear surfaces 236, 246, while the connecting peg 216 can move or travel through a range of motion between the first end 223 and the second end 225 of the receiving opening 224. In this way, the third length L3 of the third lever arm can change as the connecting peg 216 moves or travels through the range of motion between the first end 223 and the second end 225 of the receiving opening 224. By including the at least one motion take-up connection 217, 237, 247 to operably couple at least one of the third connection 217 of the lever 220 to the reciprocating shaft 212 or to operably couple at least one of the first or second connections 237, 247 of the lever 220 to the opening pin 250, the ratio of the linear distance LD2 (FIG. 7) traveled by the opening pin 250 to the linear distance LD1 (FIG. 7) traveled by the reciprocating shaft 212 can be increased compared to if none of the first, second, or third connections 217, 237, 247 were provided as motion take-up connections 217, 237, 247 and were instead provided as fixed connections.

Figure 6:
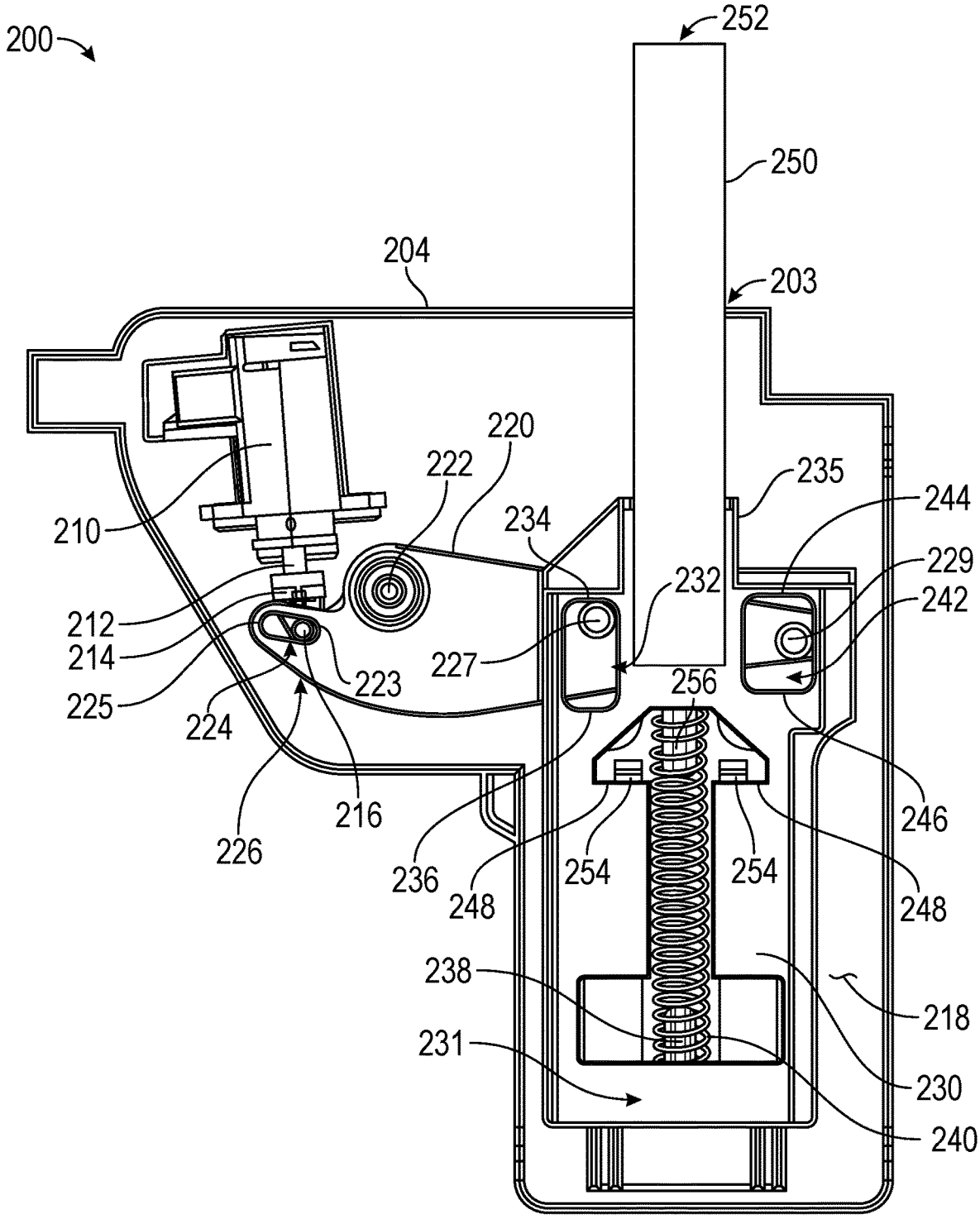
FIG. 6 is a bottom view of the door opener of FIG. 4 in a second position and shown with a lower housing removed for clarity.

Turning now to FIG. 6, the door opener 200 is shown in a second position, which is a partially extended position, and still with the lower housing 202 removed for clarity. In this partially extended position, the door opener 200 is positioned in a configuration that is between the retracted position (FIG. 5) and the extended position (FIG. 7). As illustrated, in this partially extended position, the reciprocating shaft 212 is partially extended from the actuator 210 such that the connecting peg 216 bears against the receiving opening 224, and specifically against the first end 223 of the receiving opening 224. The lever 220 is rotated about the rotation axis 222 to the partially extended position, wherein the first end 226 is rotated further away from the actuator 210, as compared to the retracted position, and the second end 228 is rotated toward the pin opening 203, as compared to the retracted position. Relative to the retracted position, the first connection element 227 is brought to bear against the front surface 234 of the first connection opening 232 while the second connection element 229 is moved toward the front surface 244 of the second connection opening 242. Accordingly, the slider 230 and the opening pin 250 are moved toward the pin opening 203 such that a greater length of the opening pin 250 extends through and beyond the pin opening 203 to the exterior of the housing 202, 204 and towards the door assembly 20. The slider 230, the opening pin 250, and the spring 240 are not moved relative to one another.

Turning now to FIG. 7, the door opener 200 is shown in a third position, which is the extended position, and still with the lower housing 202 removed for clarity. As illustrated, in the extended position, the reciprocating shaft 212 is fully extended from the actuator 210 to define the total linear distance LD1 traveled by the reciprocating shaft 212 from the retracted position to the fully extended position. With the reciprocating shaft 212 in the fully extended position, the connecting peg 216 bears against the receiving opening 224, and specifically against the second end 225 of the receiving opening 224. The position of the connecting peg 216 thus defines the third length L3 in the extended position, with the connecting peg 216 bearing against the second end 225 of the receiving opening 224, that is longer than the third length L3 in the partially extended position or in the retracted position, with the connecting peg 216 bearing against the first end 223 of the receiving opening 224. The lever 220 is rotated about the rotation axis 222 to the fully extended position, wherein the first end 226 is rotated further away from the actuator 210, as compared to the retracted position and the partially extended position, and the second end 228 is rotated toward the pin opening 203, as compared to the retracted position and the partially extended position. Relative to the partially extended position, the second connection element 229 is brought to bear against the front surface 244 of the second connection opening 242, while the front surface 234 of the first connection opening 232 is moved away from the first connection element 227, towards the pin opening 203, and the rear surface 236 of the first connection opening 232 is moved toward the first connection element 227. In one example, in the fully extended position, the rear surface 236 can contact the first connection element 227, preventing further movement of the slider 230 toward the pin opening 203 relative to the lever 220.

Accordingly, the slider 230 and the opening pin 250 are moved toward the pin opening 203 such that a greater length of the opening pin 250 extends through and beyond the pin opening 203 to the exterior of the housing 202, 204 and towards the door assembly 20, as compared to the retracted position and the partially extended position. The opening pin 250 is fully extended from the housing 202, 204 to define the total linear distance LD2 traveled by the opening pin 250 from the retracted position to the fully extended position and relative to the housing 202, 204. In the fully extended position, the opening pin 250, and specifically the end 252 of the opening pin 250, contacts and bears against the door assembly 20 to pivot the door assembly 20 out of the closed position and toward the opened position. The slider 230, the opening pin 250, and the spring 240 are not moved relative to one another.

By way of non-limiting example, the opening pin 250 can extend from the pin opening 203 to the extent that the opening pin 250 extends approximately 4 centimeters beyond the cabinet or the tub 14 in the fully extended position to push the door assembly 20 approximately 4 centimeters away from the closed position. In such an example, therefore, the linear distance LD2 traveled by the opening pin 250 would be at least 4 centimeters. The linear distance LD2 traveled by the opening pin 250 differs from the linear distance LD1 traveled by the reciprocating shaft 212, and specifically such that the linear distance LD2 traveled by the opening pin 250 is greater than the linear distance LD1 traveled by the reciprocating shaft 212, such that the ratio of the linear distance LD2 for the opening pin 250 to the linear distance LD1 for the reciprocating shaft 212 is greater than 1:1.

Figure 8:
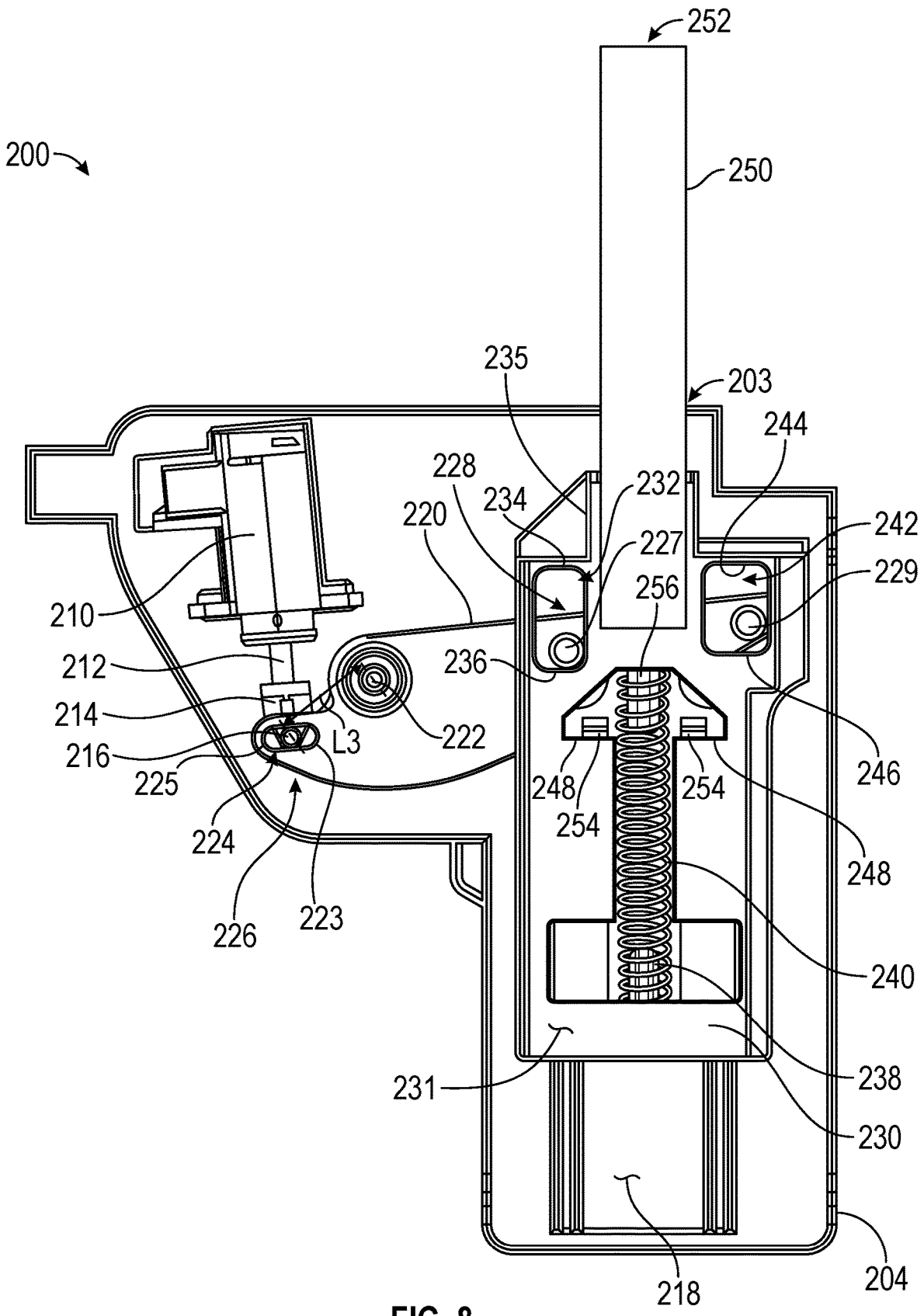
FIG. 8 is a bottom view of the door opener of FIG. 4 in a fourth position and shown with a lower housing removed for clarity.

Turning now to FIG. 8, the door opener 200 is shown in a fourth position, which is a partially retracted position, and still with the lower housing 202 removed for clarity. In this partially retracted position, the door opener 200 is positioned in a configuration that is between the extended position (FIG. 7) and the retracted position (FIG. 5), but differs from the partially extended position of FIG. 6. As illustrated, in this partially retracted position, the reciprocating shaft 212 is partially retracted toward the actuator 210, such that the connecting peg 216 bears against the receiving opening 224, and specifically against a portion of the receiving opening 224 between the first end 223 and the second end 225. This position of the connecting peg 216 thus defines the third length L3 in an intermediate position that is longer than the third length L3 in the partially extended position of FIG. 6 or in the retracted position, but that is shorter than the third length L3 in the extended position. It will be noted that the connecting peg 216 travels through this intermediate position both as the door opener 200 moves from the retracted position toward the extended position, and also from the extended position to the retracted position. The lever 220 is rotated about the rotation axis 222 to the partially retracted position, wherein the first end 226 is rotated further toward the actuator 210, as compared to the fully extended position, and the second end 228 is rotated away from the pin opening 203, as compared to the fully extended position. Relative to the fully extended position, the first connection element 227 is brought to bear against the rear surface 236 of the first connection opening 232, while the second connection element 229 is moved away from the front surface 244 of the second connection opening 242, away from the pin opening 203, and toward the rear surface 246 of the second connection opening 242. Accordingly, the slider 230 and the opening pin 250 are moved away from the pin opening 203 such that a shorter length of the opening pin 250 extends through and beyond the pin opening 203 to the exterior of the housing 202, 204 and away from the door assembly 20. The slider 230, the opening pin 250, and the spring 240 are not moved relative to one another.

Figure 9:
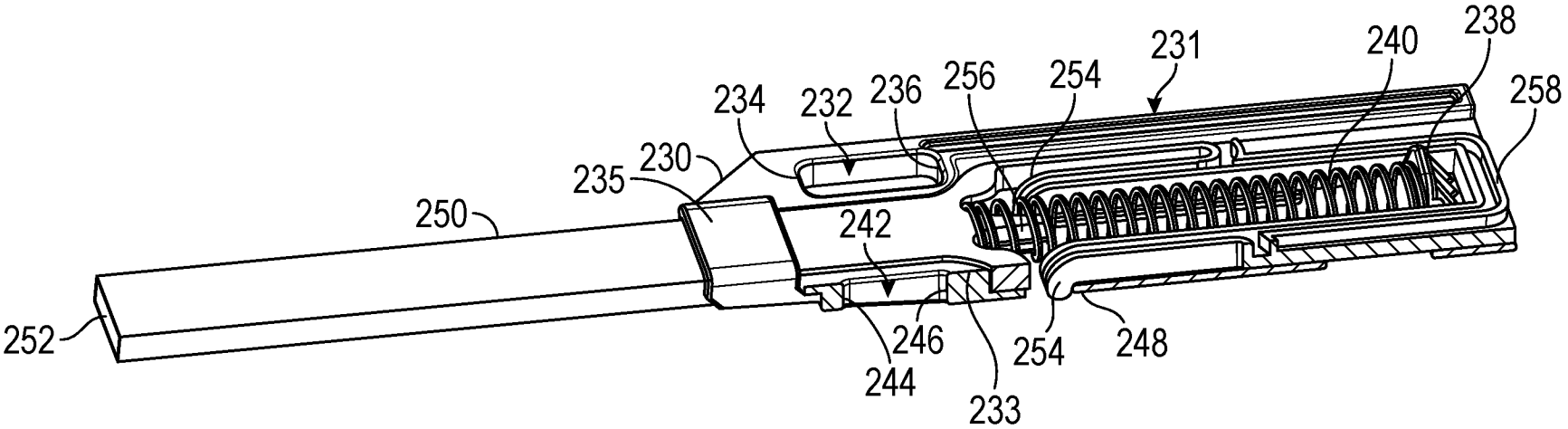
FIG. 9 is a side cross-sectional view of an opening pin and a slider for use with the door opener of FIG. 4, with the opening pin and the slider in a first position relative to one another.

Turning now to FIG. 9, the coupling of the slider 230 and the opening pin 250 is illustrated in greater detail. The slider 230 and the opening pin 250 are shown in a first position relative to one another, the first position representing a non-deflected position of the opening pin 250 relative to the slider 230. In the non-deflected position, the opening pin 250 is at least partially received by the slider body 231 and at least partially overlies the slider 230 such that the opening pin 250 is also received by the collar 235. The opening pin 250 contacts or abuts the at least one shoulder 233 such that rearward movement of the slider 230 away from the pin opening 203 causes the at least one shoulder 233 to bear against the opening pin 250 so that the opening pin 250 is moved rearwardly with the slider 230. The at least one deflectable arm 254, illustrated herein as two deflectable arms 254, overlie and abut the coupling edge 248 of the slider 230 such that forward movement of the slider 230 toward the pin opening 203 causes the coupling edge 248 to bear against the deflectable arms 254 so that the opening pin 250 is moved forward along with the slider 230. The spring 240 extends between and is retained between the first spring seat 238 of the slider 230 and the second spring seat 256 of the opening pin 250 in an uncompressed or rest condition. The opening pin 250 defines a rear edge 258. In the non-deflected position as shown, the rear edge 258 of the opening pin 250 does not protrude rearwardly beyond the slider 230.

Figure 10:
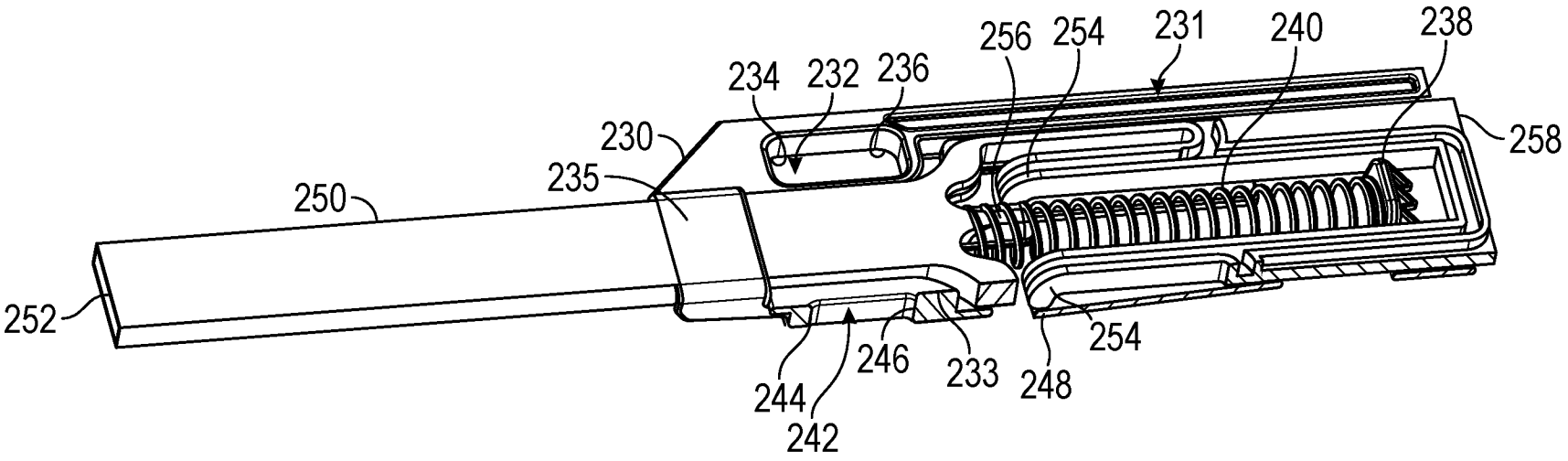
FIG. 10 is a side cross-sectional view of the opening pin and the slider of FIG. 9, with the opening pin and the slider in a second position relative to one another.

Turning now to FIG. 10, the slider 230 and the opening pin 250 are shown in a second position relative to one another, the second position illustrating a deflected position of the opening pin 250 relative to the slider 230. In the deflected position, the opening pin 250 remains at least partially received by the slider body 231 and at least partially overlies the slider 230 such that the opening pin 250 is also received by the collar 235. However, the opening pin 250, rather than contacting or abutting the at least one shoulder 233 as in the non-deflected position, is slightly spaced rearwardly from the at least one shoulder 233 in the deflected position. The deflectable arms 254 are deflected upwardly and rearwardly relative to slider 230 and are also deflected upwardly relative to the opening pin 250 itself. The deflectable arms 254 are deflected upwardly and out of engagement with the coupling edge 248 such that the slider 230 no longer carries the opening pin 250 for forward movement with the slider 230, allowing the opening pin 250 to be shifted rearwardly relative to the slider 230. In this deflected position, the rear edge 258 of the opening pin 250 protrudes rearwardly beyond the slider 230. The spring 240 extends between and is still retained between the first spring seat 238 of the slider 230 and the second spring seat 256 of the opening pin 250, but the spring 240 in the deflected position is provided in a compressed condition due to the rearward movement of the opening pin 250 toward the first spring seat 238 of the slider 230.

Under normal operation of the door opener 200 and movement of the door opener 200 and the opening pin 250 between the retracted position and the extended position, the slider 230 and the opening pin 250 remain in the non-deflected position relative to one another. The opening pin 250 is configured to move into the deflected position relative to the slider 230 when a force is applied rearwardly against the opening pin 250, such as rearwardly against the end 252 of the opening pin 250. By way of non-limiting example, sufficient force could be applied to the end 252 of the opening pin 250 to move the opening pin 250 into the deflected position relative to the slider 230 if the door assembly 20 were to be moved to the closed position or shut roughly when the door opener 200 and the opening pin 250 were in the extended position. By configuring the opening pin 250 to move to the deflected position under such circumstances, the force or energy is essentially stored by the opening pin 250 and the spring 240 rather than being transferred to the slider 230 and the lever 220, which could potentially cause wear or damage to the actuator 210. The force or energy that is stored by the opening pin 250 and the spring 240 can then be used to return or re-track the opening pin 250 and the spring 240 to the non-deflected position relative to the slider 230.

Turning now to the operation of the door opener 200, the door opener 200 begins in the retracted position of FIG. 5 until the actuator 210 is actuated, such as by receiving a control signal from the controller 22. Upon actuation, the reciprocating shaft 212 begins to extend from the actuator 210, moving from the retracted position toward the extended position in a rearward direction. As the reciprocating shaft 212 advances from the actuator 210, the connecting peg 216 bears against the retaining opening 224, pushing the first end 226 of the lever 220 rearward and causing the lever 220 to rotate about the rotation axis 222. As the connecting peg 216 rotates the lever 220, the retaining peg 216 moves from the first end 223 of the retaining opening 224 toward the second end 225 of the retaining opening 224. As the first end 226 of the lever 220 is pushed rearward to rotate the lever 220, the second end 228 of the lever 220 rotates forwardly, toward the pin opening 203. As the second end 228 of the lever 220 rotates forwardly, the first connection 237 and the second connection 247 bear forwardly to move the slider 230 forward towards the pin opening.

As the rotation of the lever 220 moves the first connection 237 and the second connection 247 to slide the slider 230 forward along the slideway 218 and towards the pin opening 203, the coupling edge 248 bears against the deflectable arms 254. The bearing of the coupling edge 248 against the deflectable arms 254 causes the opening pin 250 to also move forward towards the pin opening 203, extending the opening pin 250 through and further beyond the pin opening 203 and exteriorly of the housing 202, 204 as the door opener 200 and the opening pin 250 move from the retracted position to the fully extended position. As the opening pin 250 slides along the range of motion from the retracted position to the extended position, the end 252 of the opening pin 250 protrudes further beyond the pin opening 203 to come into contact with the door assembly 20.

As the opening pin 250 continues to extend still further beyond the pin opening 203, the end 252 continues to bear against the door assembly 20 to push the door assembly 20 from the closed position toward the opened position. The distance that the opening pin 250 continues to travel once the end 252 has come into contact with the door assembly 20 can be a predetermined distance. In one example, the predetermined distance can be specifically selected such that the opening pin 250 moves the door assembly 20 a distance that is sufficient to push the door assembly 20 far enough toward the opened position that gravity can then cause the door assembly 20 to pivot further toward the opened position.

Specifically, the door assembly 20 has a total weight or mass, as well as a center of gravity relative to the pivot axis about which the door assembly 20 pivots relative to the tub 14. The door assembly 20 can further include a hinge assembly (not shown) that pivotally mounts the door assembly 20 relative to the tub 14, the hinge assembly having a strength or force, such as to balance or hold the door assembly 20 at a certain angle or within a certain range of angles relative to the tub 14. The weight and the center of gravity of the door assembly 20, along with the properties of the hinge assembly, can be thought of as collectively determining the distance that the door assembly 20 can travel toward the opened position, from the closed position, at which point the weight of the door assembly 20 acting through the center of gravity of the door assembly 20 will cause the door assembly 20 to pivot further away from the opening pin 250 and toward the opened position due to gravity rather than due to further biasing by the opening pin 250.

In one example, the weight of the door assembly 20, the center of gravity of the door assembly 20, and the strength and other parameters of the hinged coupling of the door assembly 20 can be specifically selected such that the door assembly 20 will begin to move toward the opened position due to the effect of gravity after the door assembly 20 has moved a desired or predetermined distance away from the closed position. Further, the distance traveled by the opening pin 250 to reach the fully extended position is provided and selected specifically such that the opening pin 250 will push the door assembly 20 at least to the point at which the weight of the door assembly 20 and the center of gravity will cause the door assembly 20 to pivot further toward the opened position without further action of the door opener 200.

For example, the weight of the door assembly 20, the center of gravity of the door assembly 20, and the strength and other parameters of the hinged coupling of the door assembly 20 can be selected such that opening of the door assembly 20 by the door opener 200 to an angle corresponding to an extent less than the fully extended position of the opening pin 250 will result in the door assembly 20 being held or balanced at that angle, such as by the hinge assembly, while opening of the door assembly 20 by the door opener 200 to an angle corresponding to the fully extended position of the opening pin 250 results in the door assembly 20 falling at least some distance further toward the opened position due to gravity. In one non-limiting example, the door opener 200 and the opening pin 250 can push the door assembly 20 approximately 4 centimeters away from the closed position and toward the opened position, at which point the weight of the door assembly 20 acting through the center of gravity causes the door assembly 20 to pivot further away from the end 252 of the opening pin 250 in the fully extended position, such as to a total distance of 10 centimeters away from the closed position and toward the opened position.

While the opening pin 250 travels the total linear distance LD2 as it moves from the retracted position to the extended position, the total linear distance LD2 traveled can also be thought of as comprising first and second portions of the linear distance LD2 traveled based on which one of the first connection 237 or the second connection 247 drives the portion of the linear distance LD2 traveled by the opening pin 250. For example, as the door opener 200 begins to move from the retracted position to the extended position and the lever 220 begins to be rotated about the rotation axis 222, it is the first connecting element 227 that bears forwardly against the front surface 234 of the first connection opening 232 to move the slider 230 forward towards the pin opening 203. Thus, the portion of the linear distance LD2 that the opening pin 250 travels due to the contact between the first connecting element 227 and the front surface 234 of the first connection opening 232 can be thought of as a first portion of the linear distance LD2 that is driven by the first connection 237.

While the first connection 237 is driving the slider 230, and thus also the opening pin 250, to travel the first portion of the linear distance LD2, the rotation of the lever 220 also results in the second connecting element 229 moving within the second connection opening 242 away from the rear surface 246 and toward the front surface 244. As the slider 230 and the opening pin 250 move toward the extended position and past the partially extended position of FIG. 6, the second connecting element 229 comes into contact with the front surface 244 of the second connection opening 242. The second connecting element 229 then bears forwardly against the front surface 244 to move the slider 230 and the opening pin 250 further forward toward the pin opening 203. Additionally, as the second connecting element 229 begins to bear forwardly against the front surface 244, the further forward movement of the slider 230 brings the front surface 234 of the first connection opening 232 out of contact with the first connecting element 227 as the front surface 234 moves further away from the first connecting element 227 until the opening pin 250 and the slider 230 reach the fully extended position. Thus, the portion of the linear distance LD2 that the opening pin 250 travels due to the contact between the second connecting element 229 and the front surface 244 of the second connection opening 242 can be thought of as a second portion of the linear distance LD2 that is driven by the second connection 247.

In one non-limiting example, the further forward movement of the slider 230 and the opening pin 250 that is driven by the second connection 247 can continue until the rear surface 236 of the first connection opening 232 is brought into contact with the first connecting element 227, at which point further forward movement of the slider 230 and the opening pin 250 toward the pin opening 203 is prevented. However, it will also be understood that the door opener 200 and the opening pin 250 can reach the fully extended position prior to the rear surface 236 coming into contact with the first connecting element 227 and that some other mechanism or structure can define the fully extended position and prevent further forward movement of the slider 230 and the opening pin 250 toward the pin opening 203.

As described previously, a ratio of the linear distance LD2 traveled by the opening pin 250 to the linear distance LD1 traveled by the reciprocating shaft 212 can reflect an increased efficiency of the door opener 200 due to the first, second, and third connections 237, 247, 217 being provided as motion take-up connections 237, 247, 217. Further to the overall ratio of the linear distance LD2 to the linear distance LD1, the first connection 237 and the second connection 247 can have differing ratios relative to the linear distance LD1 traveled by the reciprocating shaft 212. For example, the ratio of the second portion of the linear distance LD2 that is driven by the second connection 247 to the linear distance LD1 traveled by the reciprocating shaft 212 can be different from the ratio of the first portion of the linear distance LD2 that is driven by the first connection 237 to the linear distance LD1 traveled by the reciprocating shaft. Specifically, the ratio of the second portion of the linear distance LD2 that is driven by the second connection 247 to the linear distance LD1 traveled by the reciprocating shaft 212 can be greater than the ratio of the first portion of the linear distance LD2 that is driven by the first connection 237 to the linear distance LD1 traveled by the reciprocating shaft 212. By way of non-limiting example, the ratio of the second portion of the linear distance LD2 that is driven by the second connection 247 to the linear distance LD1 traveled by the reciprocating shaft 212 can be approximately 4:1, requiring approximately 85 N of force, while the ratio of the first portion of the linear distance LD2 that is driven by the first connection 237 to the linear distance LD1 traveled by the reciprocating shaft 212 can be approximately 2.5:1, requiring approximately 30 N of force. It will be understood that these ratios and force values are not limiting and that the ratios and force values can vary based upon the parameters of the door opener 200 and its components and still remain within the scope of the present disclosure.

As the door opener 200 returns from the fully extended position back to the retracted position, the movement of the components of the door opener 200 are essentially the opposite of the order of movements as the door opener 200 moved from the retracted position to the extended position. The actuator 210 begins to withdraw the reciprocating shaft 212 back into the actuator 210, drawing the reciprocating shaft 212 forward into the actuator 210, moving from the extended position toward the retracted position in a forward direction. As the reciprocating shaft 212 is drawn into the actuator 210, the connecting peg 216 bears against the retaining opening 224, pulling the first end 226 of the lever 220 forward and causing the lever 220 to rotate about the rotation axis 222. As the connecting peg 216 rotates the lever 220, the retaining peg 216 moves from the second end 225 of the retaining opening 224 toward the first end 223 of the retaining opening 224. As the first end 226 of the lever 220 is pulled forward to rotate the lever 220, the second end 228 of the lever 220 rotates rearwardly, away from the pin opening 203.

As the second end 228 of the lever 220 rotates rearwardly and the door opener 200 begins to move from the extended position to the retracted position, the first connecting element 227 bears rearwardly against the rear surface 236 of the first connection opening 232 to move the slider 230 rearwardly away from the pin opening 203. As the rotation of the lever 220 moves the first connection 237 to slide the slider 230 rearward along the slideway 218 and away from the pin opening 203, the at least one shoulder 233 of the slider 230 bears against the opening pin 250. The bearing of the at least one shoulder 233 against the opening pin 250 causes the opening pin 250 to also move rearward away from the pin opening 203, retracting the opening pin 250 through and from beyond the pin opening 203 and the exterior of the housing 202, 204 as the door opener 200 and the opening pin 250 move from the fully extended position to the retracted position. As the opening pin 250 slides along the range of motion from the extended position to the retracted position, the end 252 of the opening pin 250 is withdrawn from contact with the door assembly 20. Thus, the portion of the linear distance LD2 that the opening pin 250 travels due to the contact between the first connecting element 227 and the rear surface 236 of the first connection opening 232 as the opening pin 250 moves from the extended position to the retracted position can be thought of as a first portion of the return linear distance LD2 that is driven by the first connection 237.

While the first connection 237 is driving the slider 230, and thus also the opening pin 250, to travel the first portion of the return linear distance LD2, the rotation of the lever 220 also results in the second connecting element 229 moving within the second connection opening 242 away from the front surface 244 and toward the rear surface 246. As the slider 230 and the opening pin 250 move toward the retracted position and past the partially retracted position of FIG. 8, the second connecting element 229 comes into contact with the rear surface 246 of the second connection opening 242. The second connecting element 229 then bears rearwardly against the rear surface 236 to move the slider 230 and the opening pin 250 further rearward away from the pin opening 203. Additionally, as the second connecting element 229 begins to bear rearwardly against the rear surface 246, the further rearward movement of the slider 230 brings the rear surface 236 of the first connection opening 232 out of contact with the first connecting element 227 as the rear surface 236 moves further away from the first connecting element 227 until the opening pin 250 and the slider 230 reach the retracted position. Thus, the portion of the linear distance LD2 that the opening pin 250 travels due to the contact between the second connecting element 229 and the rear surface 246 of the second connection opening 242 can be thought of as a second portion of the return linear distance LD2 that is driven by the second connection 247.

Turning now to the operation of the relative movement between the slider 230 and the opening pin 250 as described with respect to FIG. 10, as described previously, under normal operation and movement of the door opener 200 and the opening pin 250 between the retracted and extended positions, the slider 230 and the opening pin 250 are coupled to one another such that relative movement between the slider 230 and the opening pin 250 is not caused to occur. However, in the case that, for example, the door assembly 20 of the dishwasher 10 is moved or slammed to the closed position when the door opener 200 and the opening pin 250 are in the extended position, wear or damage to the lever 220 or the actuator 210 due to the impact can be avoided by providing the opening pin 250 as slidably mounted or coupled to the slider 230.

In the event of such an impact when the door opener 200 and the opening pin 250 are in the extended position and with the opening pin 250 and the slider 230 beginning in the non-deflected position of FIG. 9 relative to one another, the impact exerts a rearward force on the opening pin 250 to urge rearward movement of the opening pin 250 relative to the slider 230. If the force of the impact is sufficient to overcome the rigidity or force of the deflectable arms 254, the deflectable arms 254 will be deflected upwardly and rearwardly over the coupling edge 248 to un-couple the opening pin 250 from the slider 230, allowing rearward movement of the opening pin 250 relative to the slider 230. Once the deflectable arms 254 have been released from engagement with the coupling edge 248, the opening pin 250 moves rearwardly relative to the slider 230 such that the spring 240 is compressed between the first and second spring seats 238, 256 and the rear edge 258 of the opening pin 250 protrudes rearwardly beyond the slider 230.

When the force of the impact against the opening pin 250 has ceased, the biasing force exerted by the spring 240 and by the deflectable arms 254 will automatically bias the opening pin 250 back to the non-deflected position relative to the slider 230. It will be understood that the biasing forces of the spring 240 and of the deflectable arms 254 can be specifically selected such that the biasing forces are strong enough to not allow the opening pin 250 to move into the deflected position relative to the slider 230 under the forces of the normal operation and movement between the retracted and extended positions, but to allow the de-coupling and relative movement of the opening pin 250 and the slider 230 when they are exposed to a force of impact that could cause wear or damage to the actuator 210 were the opening pin 250 not able to de-couple from the slider 230, and thus also from the lever 220 and the actuator 210.

The aspects described herein provide a door opener for a door assembly of a dish treating appliance that incorporates several features for improved performance and durability compared to traditional door openers. The door opener of the present disclosure exhibits improved efficiency by requiring a same or smaller amount of force to move the door opener and the opening pin a greater distance than traditional door openers. By providing the lever that has two connection points to the slider and the opening pin, rather than the traditional single, fixed point of attachment, a greater range of motion can be achieved using the same actuator and without requiring greater force. Further, by providing the connection points, both for the first and second connection points to the opening pin and also for the connection point of the lever with the actuator, as motion take-up connections, the ratio of the linear distance that can be traveled by the opening pin to the linear distance traveled by the actuator is increased even further. This enables the use of an actuator-driven door opener that can still meet the necessary distance traveled, and provides a door opener solution that only pushes against the door when needed, rather than some spring-loaded solutions which constantly exert a biasing force on the door and can negatively impact sealing of the door assembly against the tub.

Not only do these features provide a more efficient door opener, but the door opener can be used to push the door assembly 4 centimeters from the closed position toward the opened position, an improved travel distance compared to traditional door openers, which will increase the likelihood that the door assembly successfully reaches the point at which it will open further due to weight and gravity and solves the issue of the door not being pushed open far enough and thus not falling open further on its own. Further still, by providing the slider and the opening pin as separate elements that are capable of movement relative to one another, an improved safety feature can be provided that allows for the impact of accidental door slams or closures when the opening pin is in the extended position to be safely absorbed by the spring and deflectable arms of the opening pin, rather than transferring the force through the other components of the door opener, such as the actuator, and potentially causing damage or wear that could require repair.

It will also be understood that various changes and/or modifications can be made without departing from the spirit of the present disclosure. By way of non-limiting example, although the present disclosure is described for use with a dishwasher having a door assembly pivotable about a horizontal axis, it will be recognized that the door assembly can be employed with various constructions, including door assemblies pivotable about a vertical axis and/or door assemblies for drawer-style dishwashers.

To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dish treating appliance comprising:

a cabinet defining an interior with an access opening;

a door hingedly mounted to the cabinet for pivoting movement about a pivot axis between closed and opened positions to selectively close and open the access opening; and a door opener comprising:

a housing mounted to the cabinet and defining a pin opening facing the door;

an opening pin located within the housing and aligned with the pin opening;

a lever rotatably mounted to the housing to define a rotation axis, and selectively operably coupled to the opening pin at first and second connections to correspondingly define first and second lever arms of different lengths; and an actuator having a reciprocating shaft connected to the lever at a third connection to define a third lever arm.

2. The dish treating appliance of claim 1 wherein the door opener further comprises at least one motion take-up connection operably coupling at least one of the third connection of the lever to the reciprocating shaft or the first or second connections of the lever to the opening pin.

3. The dish treating appliance of claim 1 wherein a ratio of the length of the first lever arm to a length of the third lever arm is different than a ratio of the length of the second lever arm to the length of the third lever arm.

4. The dish treating appliance of claim 3 wherein the ratio of the length of the first lever arm to the length of the third lever arm is less than the ratio of the length of the second lever arm to the length of the third lever arm.

5. The dish treating appliance of claim 1 wherein the housing further defines a slideway, with the opening pin slidably received within the slideway.

6. The dish treating appliance of claim 5 wherein the slideway is oriented at an acute angle relative to the horizontal.

7. The dish treating appliance of claim 5 wherein the door opener further comprises a slider slidably received within the slideway.

8. The dish treating appliance of claim 7 wherein the opening pin is carried by the slider.

9. The dish treating appliance of claim 8 wherein the first and second connections are selectively connected to the slider to correspondingly define the first and second lever arms.

10. The dish treating appliance of claim 9 wherein the opening pin is slidably mounted to the slider.

11. The dish treating appliance of claim 10 wherein the door opener further comprises a spring coupling the opening pin to the slider.

12. The dish treating appliance of claim 9 wherein the slider overlies the opening pin to form a first guide for the opening pin.

13. The dish treating appliance of claim 12 wherein the opening pin lies between the lever and the slider.

14. The dish treating appliance of claim 13 wherein the housing comprises a slot forming the pin opening to form a second guide for the opening pin.

15. The dish treating appliance of claim 14 wherein the slider has a portion overlying the opening pin on the same side of the opening pin as the lever to form a third guide for the opening pin.

16. The dish treating appliance of claim 15 wherein the third guide lies between the first and second guides relative to the opening pin.

17. The dish treating appliance of claim 1 wherein the opening pin travels through a range of motion between a retracted position and an extended position.

18. The dish treating appliance of claim 17 wherein the door has a center of gravity and the extended position is provided such that a weight of the door acting through the center of gravity causes the door to pivot away from the opening pin in the extended position.

19. The dish treating appliance of claim 1 wherein actuation of the actuator rotates the lever about the rotation axis to extend the opening pin through the pin opening and into contact with the door to move the door from the closed position toward the opened position.

20. A dish treating appliance having a door that pivotably moves about a pivot axis between closed and opened positions and a door opener for use with the door, the door opener comprising:

a housing mounted to the dish treating appliance and defining a pin opening facing the door;

an opening pin located within the housing and aligned with the pin opening;

a lever rotatably mounted to the housing to define a rotation axis, and selectively operably coupled to the opening pin at first and second connections to correspondingly define first and second lever arms of different lengths; and an actuator having a reciprocating shaft connected to the lever at a third connection to define a third lever arm.

* * * * *